US006644289B2

(12) United States Patent
Noda

(10) Patent No.: US 6,644,289 B2
(45) Date of Patent: Nov. 11, 2003

(54) FUEL SUPPLY APPARATUS

(75) Inventor: Koji Noda, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/901,672

(22) Filed: Jul. 11, 2001

(65) Prior Publication Data

US 2002/0033168 A1 Mar. 21, 2002

(30) Foreign Application Priority Data

Jul. 18, 2000 (JP) ..... 2000-217597

(51) Int. Cl.[7] ..... F02M 37/04; F04B 35/04
(52) U.S. Cl. ..... 123/509; 123/514; 417/360
(58) Field of Search ..... 123/509, 514; 417/360, 363; 220/4.14, 905

(56) References Cited

U.S. PATENT DOCUMENTS 2,084,605 A * 6/1937 Webb ..... 123/497
4,591,319 A * 5/1986 Takahashi et al. ..... 403/223
4,768,925 A * 9/1988 Geupel ..... 415/213.1
4,780,063 A * 10/1988 Tuckey ..... 137/565.24
4,795,320 A * 1/1989 Tuckey ..... 285/244
4,807,582 A * 2/1989 Tuckey ..... 123/514
4,869,225 A * 9/1989 Nagata et al. ..... 123/509
4,964,787 A * 10/1990 Hoover ..... 417/363
4,974,570 A * 12/1990 Szwargulski et al. ..... 123/509
5,002,467 A * 3/1991 Talaski et al. ..... 417/363
5,038,741 A * 8/1991 Tuckey ..... 123/497
5,050,567 A * 9/1991 Suzuki ..... 123/497
5,084,166 A 1/1992 Shiraga et al. ..... 210/172
5,165,867 A * 11/1992 Dockery ..... 417/360
5,445,503 A * 8/1995 Kmiec et al. ..... 248/674
5,482,444 A * 1/1996 Coha et al. ..... 417/363
5,642,718 A * 7/1997 Nakai et al. ..... 123/497
5,762,047 A 6/1998 Yoshioka et al. ..... 123/509
6,142,126 A * 11/2000 Kanamaru ..... 123/509
6,267,103 B1 * 7/2001 Ludwig et al. ..... 123/509
6,378,504 B1 * 4/2002 Horiuchi et al. ..... 123/509
6,382,190 B1 * 5/2002 Tanabe et al. ..... 123/509
6,450,150 B1 * 9/2002 Sanden et al. ..... 123/509
6,517,327 B2 * 2/2003 Beyer et al. ..... 417/363

FOREIGN PATENT DOCUMENTS

JP 17270 * 1/1995 ..... B69K/15/03
JP 270528 * 10/1996 ..... F02M/37/00
JP 252592 * 9/1998 ..... F02M/37/00
JP 31003 * 1/2002 ..... F02M/37/00

* cited by examiner

*Primary Examiner*—Henry C. Yuen
*Assistant Examiner*—Hai Huynh
(74) *Attorney, Agent, or Firm*—Sughrue Mion, PLLC

(57) ABSTRACT

A fuel supply apparatus for an internal combustion engine includes a fuel pump disposed in a fuel tank. The fuel tank is supported by a tubular bracket secured to a mounting plate installed in an opening of a fuel tank and extending into the fuel tank. The bracket surrounds the fuel pump and restrains the fuel pump along its outer periphery. The bracket may include inwardly projecting portions for restraining the fuel pump.

14 Claims, 5 Drawing Sheets

FUEL SUPPLY APPARATUS

REFERENCE TO RELATED APPLICATIONS

This application is based on Japanese Patent Application No. 2000-217597, filed in Japan on Jul. 18, 2000, the contents of which are hereby incorporated by reference.

BACKGROUND OF THE INVENTION

1. Field of the Invention

This invention relates to a fuel supply apparatus which is mounted on a fuel tank and supplies fuel from within the fuel tank to an internal combustion engine. In particular, it relates to a fuel supply apparatus for use on a conveyance, such as a jet ski, which repeatedly undergoes abrupt accelerations and decelerations during normal operation.

2. Description of the Related Art

FIG. 5 is a partially cross-sectional elevation of a fuel supply apparatus disclosed in Japanese Published Unexamined Utility Model Application Hei 2-11476. In this figure, element number 1 is a fuel tank which houses fuel 2. 3 is a mounting plate which seals the opening 1*a* of the fuel tank 1 in a liquid-tight manner, 4 is a flat bracket which is secured to the mounting plate 3 and from which is suspended a fuel pump 7. 5 is a retainer which is secured to the bracket 4 by tightening screws 6 and which works together with a cushion 8 to restrain the fuel pump 7. The fuel pump 7 discharges fuel 2 from within the fuel tank 1 through a discharge opening 7*a* of the fuel pump 7. The cushion 8, which acts to restrain the fuel pump 7, is disposed between the lower surface of the fuel pump 7 and the retainer 5 and is made of molded rubber or similar material which can absorb vibrations which are generated when the fuel pump 7 operates.

9 is a discharge pipe which extends from the top surface of the mounting plate 3 and leads fuel 2 which is discharged by the fuel pump 7 to outside the fuel tank 1. 10 is a joint which connects the discharge opening 7*a* of the fuel pump 7 to the discharge pipe 9. 11 is a suction filter which is connected to the suction port 7*b* of the fuel pump 7 and filters out iron powder and other debris contained in the fuel 2. 12 is a power supply connector which is disposed on the top surface of the mounting plate 3 and which supplies current from an unillustrated battery to a power supply terminal 7*c* of the fuel pump 7 through a current supply line 13. 14 is a return pipe which returns excess fuel which has been discharged from the discharge pipe 9 to the interior of the fuel tank 1 after it has been supplied to an unillustrated internal combustion engine.

When current is supplied from the unillustrated battery to a direct current motor (not shown) within the fuel pump 7 through the power supply connector 12, the power supply line 13, and the power supply terminal 7*c* and the direct current motor rotates, due to the pumping action of the fuel pump 7, fuel 2 within the fuel tank 1 is drawn through the suction filter 11. After debris such as iron powder contained in the fuel 2 is filtered out by the suction filter 11, the fuel 2 is sucked in through the suction port 7*b* of the fuel filter 7, and it is supplied to the internal combustion engine from the discharge port 7*a* through the joint 10 and the discharge pipe 9.

If a fuel supply apparatus of this type is employed in a conveyance, such as a jet ski, which repeatedly undergoes abrupt accelerations and decelerations during normal operation, the abrupt changes in velocity result in inertial forces which are proportional to the mass of the fuel supply apparatus, and particularly to the mass of the fuel pump 7 which constitutes most of the mass of the fuel supply apparatus. Abrupt accelerations and decelerations also cause movement of the fuel 2 within the fuel tank 1, and the fuel 2 applies impact forces to the bracket 4 from which the fuel pump 7 is suspended. The impact forces are also transmitted by the bracket 4 to the joint 10 which connects the discharge opening 7*a* of the fuel pump 7 to the discharge pipe 9, and to the power supply line 13 which supplies current to the fuel pump 7.

In contrast to a fuel tank for a passenger car, which has a relatively shallow depth, a fuel tank 1 used in a jet ski has a considerable depth compared to its horizontal dimensions, so the bracket 4 which extends into the fuel tank 1 tends to be elongated. As a result, when the above-described inertial forces and impact forces are applied to the bracket 4, the bracket 4 deforms under the resulting stresses, and the deformation of the bracket 4 may cause the suction filter 11 to contact the bottom surface of the fuel tank 1. In this situation, the fuel pump 7 may become unable to draw in fuel 2 through the suction filter 11, or the suction filter 11 may become detached from the suction port 7*b*, allowing unfiltered fuel 2 to enter the fuel pump 7.

Furthermore, the joint 10 and the electric power supply line 13 may be damaged by stresses caused by the impact forces resulting from movement of the fuel 2 in the fuel tank 1, with the result that the fuel pump 7 may stop working properly.

SUMMARY OF THE INVENTION

The present invention provides a fuel supply apparatus in which a fuel pump can operate normally and fuel within the fuel tank can be stably discharged to an internal combustion engine without unacceptable deformation of a bracket supporting the fuel pump within the fuel tank and without damage to a joint or a power supply line when the fuel supply apparatus is subjected to large inertial forces caused by abrupt accelerations or decelerations, or when subjected to impact forces caused by movement of fuel within the fuel tank.

According to one form of the present invention, a fuel supply apparatus includes a mounting plate installed in an opening of a fuel tank, a discharge pipe mounted on the mounting plate, a fuel pump which is disposed in the fuel tank and which discharges fuel from the fuel tank to a fuel injector or other component of an internal combustion engine through the discharge pipe, and a tubular bracket which is secured to the mounting plate and which projects into the fuel tank. The bracket has a portion which surrounds and restrains the fuel pump along an outer periphery of the fuel pump. In a preferred embodiment, the portion of the bracket which surrounds and restrains the fuel pump has a plurality of inwardly projecting portions which restrain the fuel pump along its outer periphery.

In a preferred embodiment, the bracket includes an upper portion, a middle portion, and a lower portion connected to each other, with the middle portion having dimensions appropriate for the depth of the fuel tank.

The bracket may be equipped with one or more holes in a lateral surface thereof through which fuel can pass to permit fuel to enter into the interior of the bracket.

In a preferred embodiment, a joint which connects the discharge opening of the fuel pump to a discharge pipe which leads fuel to the outside of the fuel tank, and a power supply line which supplies electric current to the fuel pump are disposed in a space formed inside the bracket between the fuel pump and the mounting plate.

In another preferred embodiment, a fuel filter which filters fuel which is discharged to a fuel injector, for example, of an internal combustion engine and a pressure regulator which regulates the pressure of the fuel which is discharged to the fuel injector are disposed in the space formed inside the bracket between the fuel pump and the mounting plate.

The fuel supply apparatus may include a suspension disposed between the bracket and the bottom surface of the fuel tank for absorbing stresses applied to the fuel supply apparatus.

In a preferred embodiment, the suspension includes a spring which carries out elongation and contraction when an external stress is applied, a spring holder which holds the spring, a shaft which reciprocates with respect to the bracket as the spring elongates and contracts, and a guide on the bracket which slidably engages the guide shaft.

DESCRIPTION OF PREFERRED EMBODIMENTS

Figure 1:
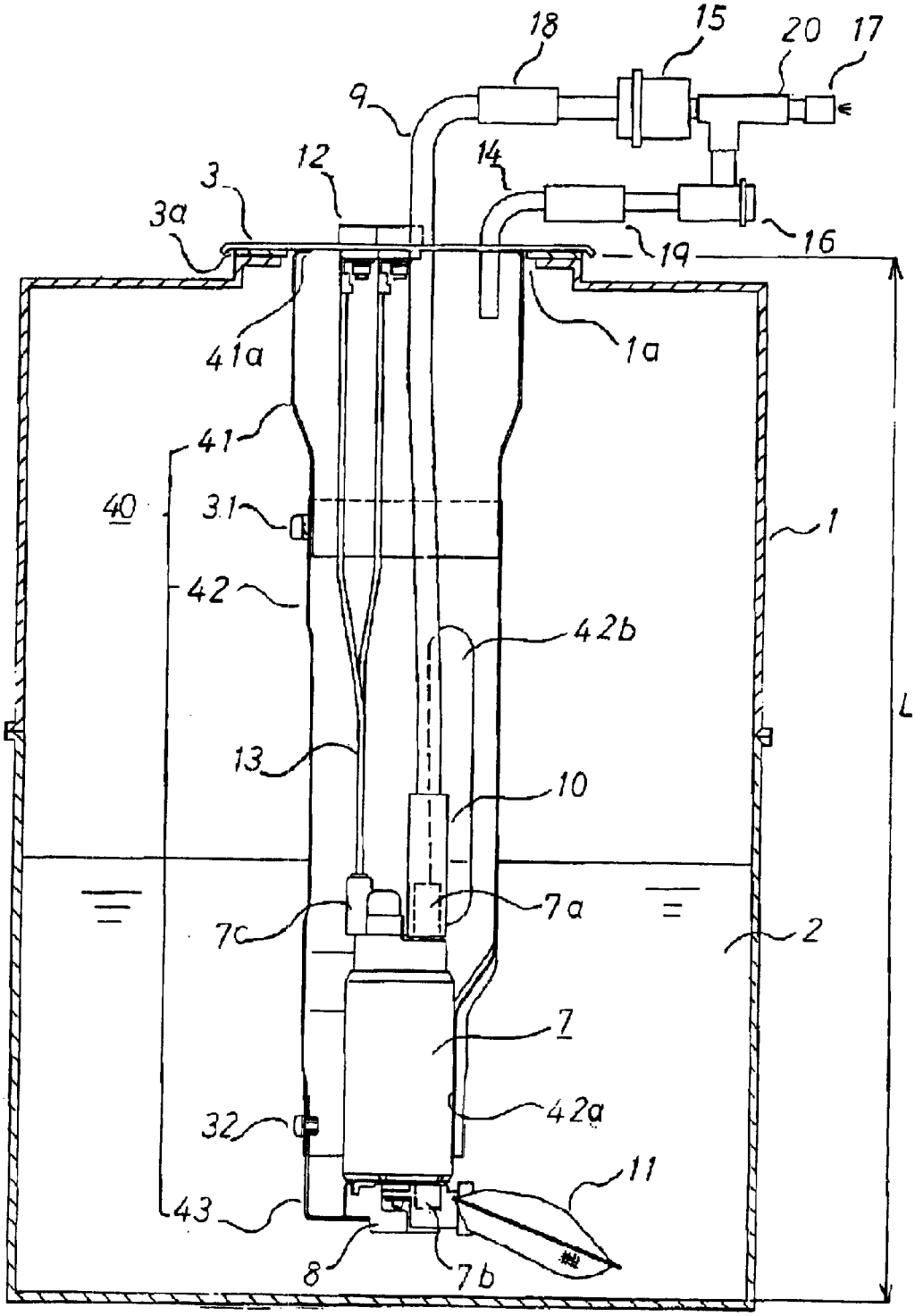
FIG. 1 is a partially cross-sectional elevation of a first embodiment of a fuel supply apparatus according to the present invention.

A first embodiment of a fuel supply apparatus according to the present invention will be described while referring to FIGS. 1 and 2, which are respectively a partially cross-sectional elevation and a bottom view of this embodiment.

In these figures, element number 1 is a fuel tank which houses fuel 2 for an unillustrated internal combustion engine, and 3 is a mounting plate which seals the opening 1*a* of the fuel tank 1 in a liquid-tight manner by means of a packing 3*a*.

7 is a fuel pump which has a tubular outer peripheral surface and which draws fuel 2 within the fuel tank 1 from a suction port 7*b* at its lower end and discharges the fuel 2 from a discharge port 7*a* at its upper end. 8 is a cushion which is disposed between the bottom surface of the fuel pump 7 and the lower portion 43 of a bracket 40 (to be described below) which supports the fuel pump 7 from below. The cushion 8 is made of molded rubber or similar material capable of absorbing vibrations generated during operation of the fuel pump 7. 9 is a discharge pipe which is installed on the upper surface of the mounting plate 3 and which leads fuel which is discharged from the fuel pump 7 to outside the fuel tank 1. 10 is a joint which connects the discharge port 7*a* of the fuel pump 7 and the discharge pipe 9. 11 is a suction filter which is formed of a mesh or other suitable material and which is connected to the suction port 7*b* of the fuel pump 7. The suction filter 11 filters out debris such as iron powder contained in the fuel 2 before the fuel 2 enters the fuel pump 7.

12 is a power supply connector which is installed on the top surface of the mounting plate 3 and which supplies current from an unillustrated battery to a power supply terminal 7*c* of the fuel pump 7 through a power supply line 13. 14 is a return pipe which returns excess fuel which was discharged from the discharge pipe 9 to inside the fuel tank 1 and was not used by the internal combustion engine.

15 is a fuel filter which filters fuel 2 which is discharged from the discharge pipe 9. 16 is a pressure regulator which regulates the pressure of the fuel 2 which is discharged from the fuel filter 15 to a prescribed level. 17 is a fuel injector which injects the fuel 2 into the internal combustion engine. FIG. 1 shows only a single fuel injector 17, but there may be any desired number of fuel injectors 17, depending upon the size and the design of the engine. 18 is a rubber hose which is connected between the discharge pipe 9 and the fuel filter 15, 19 is a rubber hose which is connected between the return pipe 14 and the pressure regulator 16, and 20 is another rubber hose which connects the pressure regulator 16 and the fuel injector 17 in parallel with each other to the fuel filter 15.

40 is a tubular bracket which is formed from iron or steel sheet or other metallic material, for example, compatible with the fuel 2. The bracket 40 includes an upper portion 41 which is secured to the mounting plate 3 at a securing portion 41*a* by welding or other convenient method, a middle portion 42 which is rigidly connected to the upper portion 41 by one or more securing screws 31, and a lower portion 43 which is rigidly connected to the middle portion 42 by one or more securing screws 32. The tubular bracket 40 may have various transverse cross-sectional shapes, such as circular, oval or a streamlined shape.

Figure 2:
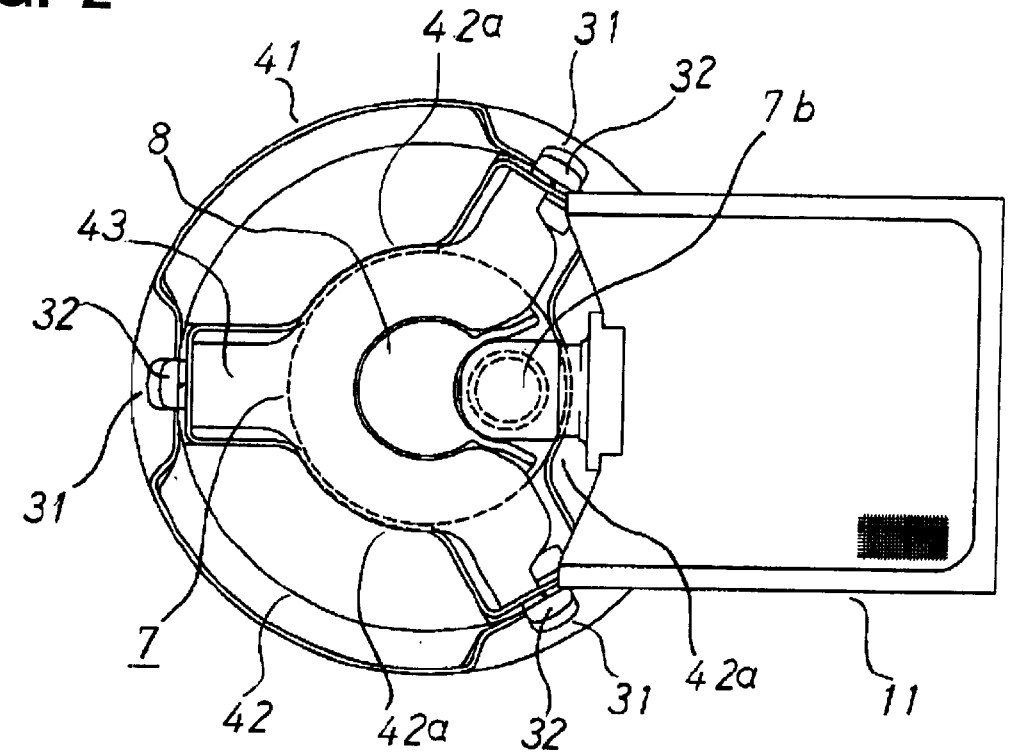
FIG. 2 is a bottom view of the fuel supply apparatus of FIG. 1.

As shown in FIG. 2, at a plurality of locations around its periphery (at 3 locations in the present embodiment), the middle portion 42 has inwardly projecting portions 42*a* for laterally restraining the outer periphery of the fuel pump 7. The inwardly projecting portions 42*a* may be formed by drawing or other suitable metalworking process. The depth L of the fuel tank 1 (shown in FIG. 1) varies with the type and the size of the internal combustion engine on which the fuel supply apparatus is mounted. In order to cope with variations in the depth L of the fuel tank 1, the dimensions of the middle portion 42 may vary in accordance with the depth L of the fuel tank 1 so as to optimize the position of the fuel pump 7 in the fuel tank 1, while the dimensions of the upper portion 41 and the lower portion 43 may be the same and thus standardized regardless of the depth L of the fuel tank 1. Namely, when installing brackets 40 on two fuel tanks 1 of different depths and requiring brackets of different lengths, the same upper portions 41 and lower portions 43 can be used on both fuel tanks 1, with only the middle portions 42 of the two brackets 40 being different from each other in length.

With the structure shown in FIGS. 1 and 2, the upper end of the fuel pump 7 is restrained by the joint 10, the lower end of the fuel pump 7 is restrained by the cushion 8 and the lower portion 43 of the bracket 40, and the outer periphery of the fuel pump 7 is restrained by the inwardly projecting portions 42*a* of the middle portion 42 of the bracket 40, so the fuel pump 7 is strongly secured. One or more holes 42*b* through which fuel 2 can easily pass may be formed in the lateral surface of the middle portion 42 of the bracket 40. The holes 42*b* make it possible for fuel 2 to readily enter into the interior of the bracket 40 and thereby minimize the amount by which the volume of the bracket 40 reduces the fuel capacity of the fuel tank 1.

The embodiment of FIGS. 1 and 2 operates in the following manner. When current is supplied to a direct current motor (not shown) within the fuel pump 7 from a battery (not shown) through the power supply connector 12, the power supply line 13, and the power supply terminal 7*c* and the direct current motor rotates, fuel 2 within the fuel tank 1 is drawn in through the suction filter 11 by the pumping action of the fuel pump 7. After debris such as iron power contained in the fuel 2 is filtered out, the fuel 2 is drawn through the suction port 7*b* of the fuel pump 7.

After the fuel 2 which is drawn into the fuel pump 7 is increased in pressure within the fuel pump 7, the fuel 2 is supplied from the discharge port 7*a* through the joint 10, the discharge pipe 9, rubber hose 18, the fuel filter 15, and rubber hose 20 to the fuel injector 17, and the fuel 2 is injected into the unillustrated internal combustion engine by the fuel injector 17. The fuel 2 is controlled to a prescribed pressure by the pressure regulator 16, and the fuel 2 which is not injected by the fuel injector 17 is returned to inside the fuel tank 1 through rubber hose 19 and the return pipe 14.

Figure 5:
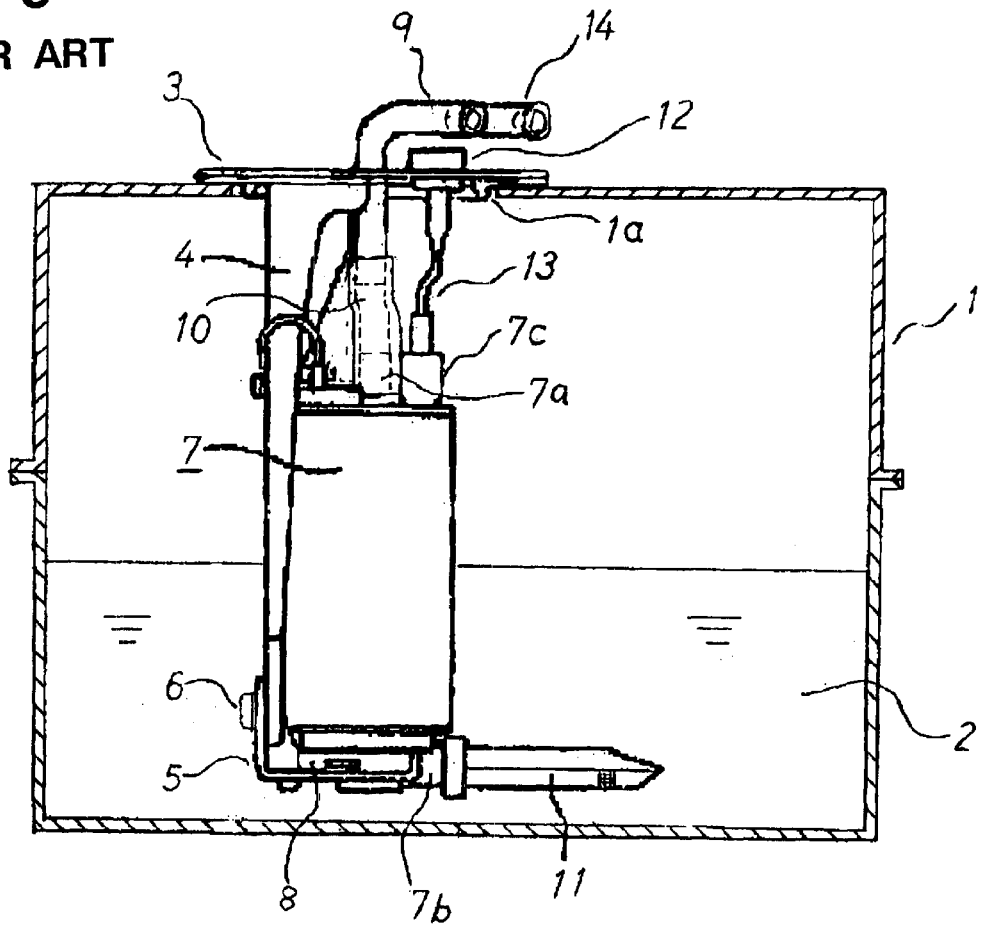
FIG. 5 PRIOR ART
FIG. 5 is a partially cross-sectional elevation of a known fuel supply apparatus.

In this embodiment, the bracket 40 is made of a metal formed into a tubular shape, so the bracket 40 has high mechanical strength. Furthermore, the fuel pump 7 can be strongly restrained by the inwardly projecting portions 42*a* of the bracket 40. The tubular shape of the bracket 40 gives it a lower fluid resistance than a flat bracket like bracket 4 of the apparatus shown in FIG. 5, so that it is subjected to lower impact forces due to movement of fuel 2 within the fuel tank 1 than a flat bracket.

As a result, the bracket 40 does not significantly deform when subjected to inertial forces during abrupt accelerations and decelerations, or when subjected to repeated impact forces caused by movement of fuel 2 within the fuel tank 1. Accordingly, there are no instances of the fuel pump 7 being unable to draw fuel 2 due to the suction filter 11 contacting the bottom surface of the fuel tank 1, and no instances of the suction filter 11 becoming detached from the suction port 7*b*, so the fuel supply apparatus can stably discharge fuel 2.

Furthermore, as the joint 10 which connects the discharge port 7*a* of the fuel pump 7 to the discharge pipe 9 and the power supply line 13 which supplies current to the fuel pump 7 are disposed in space formed inside the bracket 40 between the fuel pump 7 and the mounting plate 3, impact forces caused by movement of the fuel 2 within the fuel tank 1 are not applied directly to the joint 10 or the power supply line 13, so the joint 10 and the power supply line 13 are not damaged and the operation of the fuel pump 7 is not affected by such impact forces.

In this embodiment, the upper portion 41, the middle portion 42, and the lower portion 43 of the bracket 40 are separate components which are connected to each other by screws or other suitable means, but two or more of the portions 41–43 may be formed as a single member. For example, the upper portion 41 and the middle portion 42 may be formed as a single member, or the middle portion 42 and the lower portion 43 may be formed as a single member.

The upper portion 41, the middle portion 42, and the lower portion 43 may be connected to each other by means other than screws 31 and 32. For example, overlapping regions of portions 41–43 may be secured to each other by an interference fit.

A hole 42*b* through which fuel can pass into the interior of the bracket 40 may be formed in a region of the bracket 40 other than or in addition to the middle portion 42, such as the upper portion 41. The number of holes 42*b* which are formed in the bracket 40 may be any number which does not adversely affect the strength of the bracket 40. The provision of holes 42*b* in the bracket 40 not only permits fuel to readily enter into the interior of the bracket 40, but it also reduces the weight of the bracket 40.

Figure 3:
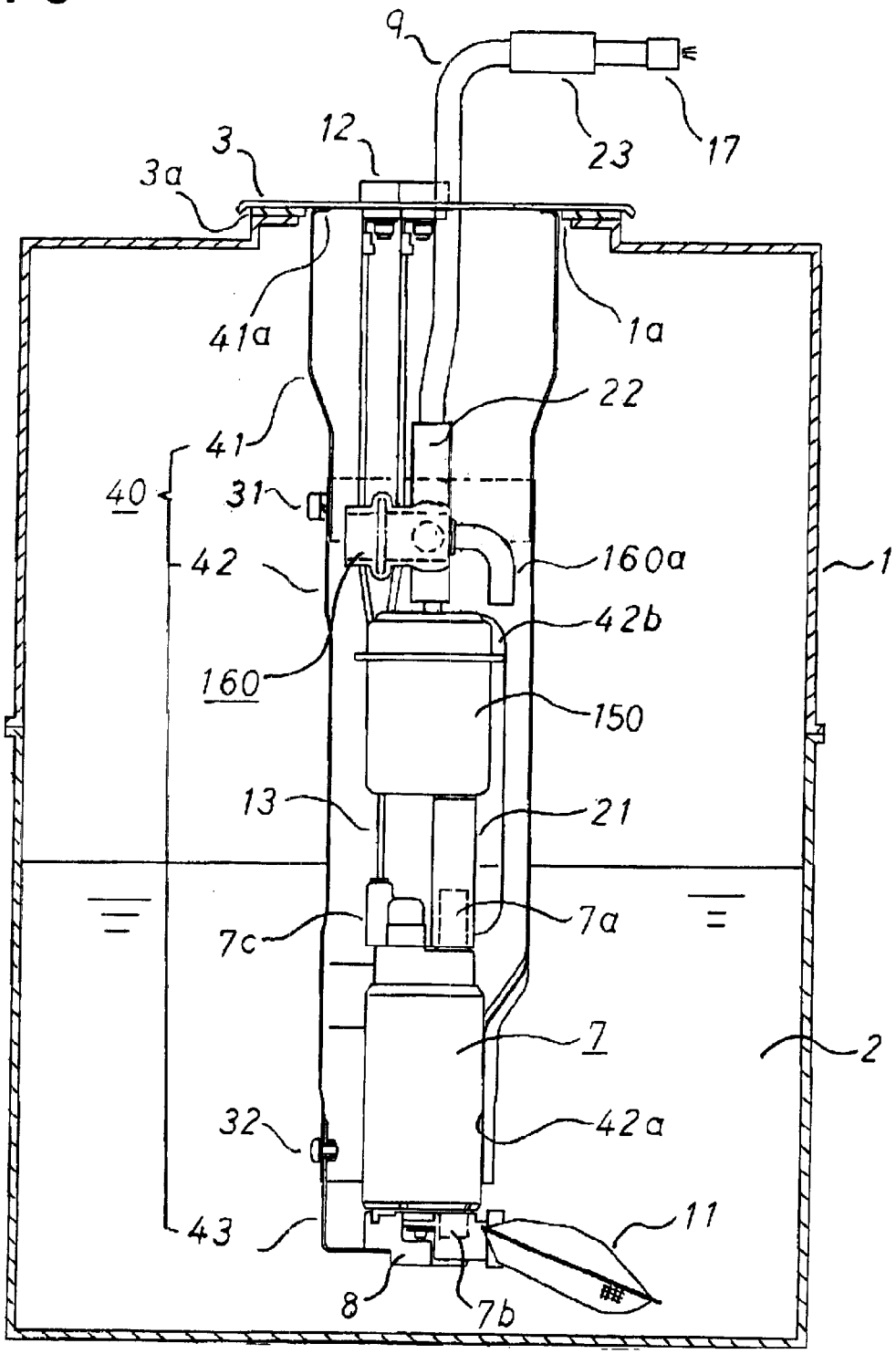
FIG. 3 is a partially cross-sectional elevation of a second embodiment of a fuel supply apparatus according to the present invention.

FIG. 3 is a partially cross-sectional elevation of a second embodiment of a fuel supply apparatus according to the present invention. In this figure, element number 150 is a fuel filter which filters fuel 2 which is discharged from the discharge port 7*a* of the fuel pump 7 through a rubber hose 21. 160 is a pressure regulator which regulates the pressure of the fuel 2 which is discharged from the fuel filter 150 to a prescribed level. 22 is a rubber hose which connects the discharge pipe 9 and the pressure regulator 160 in parallel with each other to the fuel filter 150 in the same manner as does rubber hose 20 in FIG. 1.

160*a* is a return pipe which is secured by brazing or other suitable method to the pressure regulator 160 and which returns excess fuel which was discharged from the fuel filter 150 but not injected by the fuel injector 17. The structure of this embodiment is otherwise the same as that of the preceding embodiment.

The embodiment of FIG. 3 operates in the following manner. When current is supplied from a battery (not shown) through the power supply connector 12, the power supply line 13, and the power supply terminal 7*c* to a direct current motor (not shown) within the fuel pump 7 and the direct current motor rotates, due to the pumping action of the fuel pump 7, fuel 2 within the fuel tank 1 is drawn through the suction filter 11, and after debris such as iron powder contained in the fuel 2 is filtered out, the fuel 2 is sucked in through the suction port 7*b* of the fuel pump 7.

After the fuel 2 which is sucked into the fuel pump 7 is increased in pressure within the fuel pump 7, it is supplied from the discharge port 7*a* through the joint 21, the fuel filter 150, rubber hose 22, the discharge pipe 9, and rubber hose 23 to the fuel injector 17, and the fuel 2 is injected into the internal combustion engine by the fuel injector 17. The pressure of the fuel 2 is regulated to a prescribed pressure by the pressure regulator 160. Remaining fuel 2 which is not injected by the fuel injector 17 passes through the return pipe 160*a* and returns to the fuel tank 1.

In this embodiment, the fuel filter 150 which filters the fuel 2 and the pressure regulator 160 which regulates the pressure of the fuel 2 are housed in the space formed inside the bracket 40 between the fuel pump 7 and the mounting plate 3, so a more compact arrangement with more efficient use of space is obtained than when they are mounted on the exterior of the fuel tank 1. Furthermore, because they are disposed inside the fuel tank 1 rather than outside it, the fuel filter 150 and the pressure regulator 160 are protected against contact with water or salt water which can cause their corrosion, so their life span can be extended.

Figure 4:
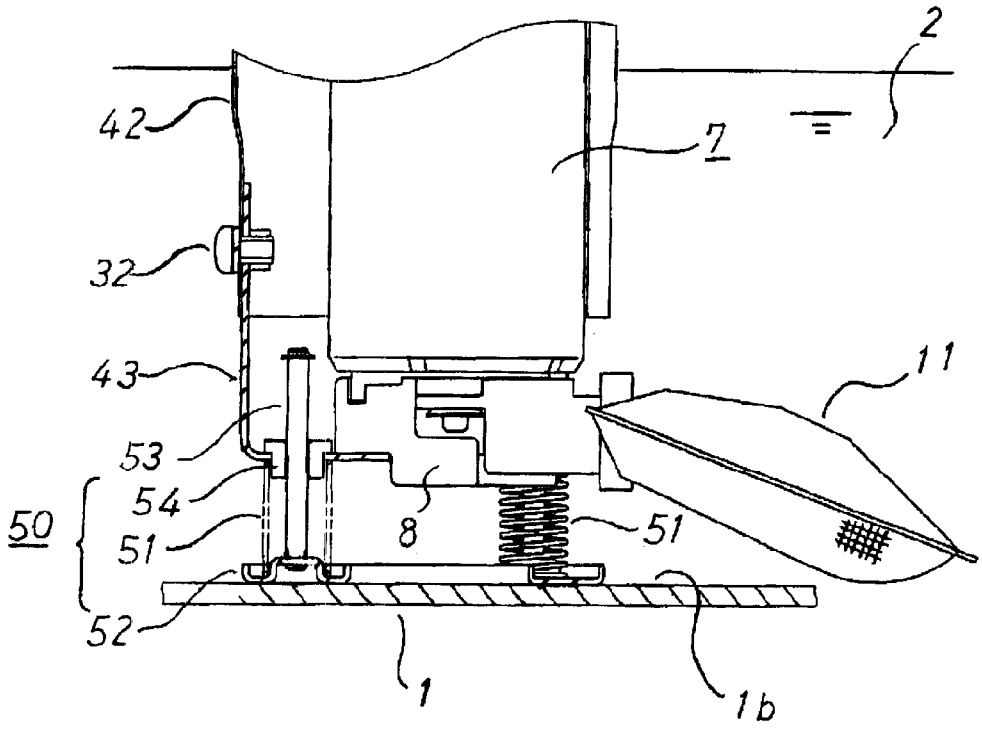
FIG. 4 is a partially cross-sectional elevation of the lower portion of a third embodiment of a fuel supply apparatus according to the present invention.

FIG. 4 is a partially cross-sectional elevation of the lower portion of a third embodiment of a fuel supply apparatus according to the present invention. In this figure, element number 50 is a suspension which is disposed between the lower portion 43 of the bracket 40 and the bottom surface 1*b* of the fuel tank 1. The suspension 50 includes a spring 21 which can expand and contract when stress is applied, a spring holder 52 which supports the lower end of the spring 51, a shaft 53 which reciprocates with respect to the bracket 40 as the spring 51 expands and contracts, and a guide 54 which smoothly guides the shaft 53 as it reciprocates with respect to the bracket 40.

The suspension 50 may include one or more of elements 51–54. For example, in the present embodiment, the suspension 50 includes three springs 51, three reciprocating shafts 53, and three guides 54, with the three springs 51 being supported by a single annular spring holder 52. The structure of this embodiment may be otherwise the same as that of either of the preceding embodiments, and it supplies fuel 2 from the fuel tank 1 to a fuel injector 17 in the same manner as in those embodiments.

In this embodiment, the fuel supply apparatus is supported both from above by the mounting plate 3 on the opening 1*a* of the fuel tank 1 and from below by the bottom surface 1*b* of the fuel tank 1, to which a compressive load can be transmitted by the springs 51 of the suspension 50. Accordingly, the fuel supply apparatus is more strongly supported than in the preceding embodiments.

Due to the ability of the suspension 50 to expand and contract, the fuel supply apparatus can be reliably supported from below without the need for the fuel tank 1 or the bracket 40 to be manufactured with high tolerances. The suspension 50 can compensate for variations in the clearance between the lower end of the fuel supply apparatus and the bottom surface 1*b* of the fuel tank 1 due to manufacturing variations, particularly when the fuel tank is made of a molded synthetic resin. The suspension 50 can also compensate for variations in the dimensions of the fuel tank 1 caused by temperature changes.

As described above, a fuel supply apparatus according to the present invention can provide advantages such as the following:

(1) By employing a tubular bracket, which has a high mechanical strength for its weight, a fuel pump can be strongly restrained, so the bracket will not significantly deform when subjected to large inertial forces caused by abrupt accelerations and decelerations of a jet ski or other conveyance in which the fuel supply apparatus is installed or when subjected to impact forces caused by movement of fuel within the fuel tank. As a result, there are no instances of the fuel pump being unable to draw in fuel due to the suction filter contacting the bottom surface of the fuel tank, and no instances of the suction filter becoming detached from the suction port, so the fuel supply apparatus can stably discharge fuel.

(2) By forming the middle portion of the bracket separately from the upper portion and/or the lower portion, the same upper and lower portions of the bracket can be used for fuel tanks of different depths, with only the middle portion of the bracket being changed for different fuel tanks having different depths. Thus, the fuel supply apparatus can be used with fuel tanks of different sizes with only a small number of changes in parts.

(3) The provision of one or more holes for fuel in the bracket allows fuel to easily enter into the interior of the bracket and thereby minimizes any decrease in the fuel capacity of the fuel tank caused by the bracket. The provision of holes also permits a decrease in the weight of the bracket.

(4) By installing a joint and a power supply line inside the bracket, they can be protected against damage due to the direct action of impact forces resulting from movement of fuel in the fuel tank.

(5) By installing a fuel filter and a pressure regulator inside the bracket, a more compact arrangement with more efficient use of space is obtained than when they are mounted on the exterior of the fuel tank, and the fuel filter and the pressure regulator can be protected against contact with water or salt water which can cause their corrosion.

(6) By installing a suspension between the lower end of the bracket and the bottom surface of the fuel tank, the fuel supply apparatus can be better supported than when supported only from above.

(7) In addition, by employing a suspension which can expand and contract, variations in the dimensions of the fuel tank due to manufacturing variations or due to dimensional changes caused by variations in temperature can be accommodated by the suspension.

What is claimed is:

1. A fuel supply apparatus comprising:

a mounting plate which is installed on an opening of a fuel tank;

a discharge pipe which is mounted on the mounting plate;

a fuel pump which is disposed in the fuel tank and discharges fuel from the fuel tank to an internal combustion engine through the discharge pipe; and a tubular bracket which is secured to the mounting plate and which projects into the fuel tank and which has a portion which surrounds and restrains the fuel pump along an outer periphery of the fuel pump, wherein the portion which surrounds and restrains the fuel pump has a plurality of inwardly projecting portions which restrain the fuel pump along its outer periphery.

2. A fuel supply apparatus as claimed in claim 1, wherein the bracket comprises metal, and the inwardly projecting portions are formed by metal drawing.

3. A fuel supply apparatus as claimed in claim 1 wherein the bracket comprises an upper portion, a middle portion, and a lower portion formed separately from each other and connected to each other in series.

4. A fuel supply apparatus as claimed in claim 1 wherein the bracket has a hole in a lateral surface thereof through which fuel can pass into the interior of the bracket.

5. A fuel supply apparatus as claimed in claim 1 including a joint which connects a discharge opening of the fuel pump and the discharge pipe and a power supply line for supplying electric current to the fuel pump, the joint and the power supply line being disposed inside the bracket between the fuel pump and the mounting plate.

6. A fuel supply apparatus as claimed in claim 1 including a fuel filter for filtering fuel which is discharged to the internal combustion engine and a pressure regulator for regulating the pressure of the fuel which is discharged to the engine, the fuel filter and the pressure regulator being disposed inside the bracket between the fuel pump and the mounting plate.

7. A fuel supply apparatus as claimed in claim 1 including a suspension connected between the bracket and a bottom surface of the fuel tank.

8. A fuel supply apparatus as claimed in claim 7 wherein the suspension includes a spring holder supported by the bottom surface of the fuel tank, a spring supported by the spring holder between the bracket and the bottom surface of the fuel tank and capable of carrying out elongation and contraction when an external stress is applied, a shaft which reciprocates with the elongation and contraction of the spring, and a guide mounted on the bracket which guides the shaft as the shaft reciprocates.

9. A fuel supply apparatus comprising:

a fuel tank operable to accommodate fuel;

a mounting plate which seals an opening of the fuel tank;

a discharge pipe operable to lead fuel outside of the fuel tank;

a fuel pump disposed in the fuel tank and operable to discharge fuel from the fuel tank through the discharge pipe; and a bracket which is secured to the mounting plate and projects into the fuel tank, wherein the bracket has a plurality of inwardly projecting portions which restrain the fuel pump by contacting an outer periphery of the fuel pump.

10. A fuel supply apparatus as claimed in claim 9, wherein the bracket comprises metal, and the inwardly projecting portions are formed by metal drawing.

11. A fuel supply apparatus as claimed in claim 9, wherein the bracket comprises an upper portion, a middle portion, and a lower portion formed separately from each other and connected to each other in series.

12. A fuel supply apparatus as claimed in claim 9, wherein the bracket is tubular in shape.

13. A fuel supply apparatus as claimed in claim 12, wherein the bracket has a hole in a lateral surface thereof through which fuel can pass into the interior of the bracket.

14. A fuel supply apparatus as claimed in claim 9, further comprising a joint which connects a discharge opening of the fuel pump and the discharge pipe and a power supply line for supplying electric current to the fuel pump, the joint and the power supply line being disposed inside the bracket between the fuel pump and the mounting plate.

* * * * *